United States Patent [19]

Forman

[11] Patent Number: 4,679,693

[45] Date of Patent: Jul. 14, 1987

[54] LABEL RESEALING CONTAINER

[76] Inventor: Harold Forman, P.O. Box 363, Conshohocken, Pa. 19428

[21] Appl. No.: 863,073

[22] Filed: May 14, 1986

[51] Int. Cl.[4] ..... B65D 81/24

[52] U.S. Cl. ..... 206/610; 206/632; 206/633; 206/607; 206/628

[58] Field of Search ..... 206/610, 604, 607-609, 206/611, 612, 613, 615, 621, 622, 628-630, 631, 633, 634, 632, 813; 383/66, 52, 5; 220/359

[56] References Cited

U.S. PATENT DOCUMENTS

| | | | |
|---|---|---|---|
| 3,002,674 | 10/1961 | Wright | 206/604 |
| 3,687,352 | 8/1972 | Kazajian | 206/612 |
| 4,192,420 | 3/1980 | Worrell, Sr. et al. | 206/607 |
| 4,197,949 | 4/1982 | Carlsson | 206/628 |
| 4,420,080 | 12/1983 | Nakamura | 206/607 |
| 4,552,269 | 11/1985 | Chang | 206/632 |
| 4,610,357 | 9/1986 | Nakamura | 206/607 |

*Primary Examiner*—Willis Little

*Attorney, Agent, or Firm*—Ruth Moyerman

[57] ABSTRACT

A resealable container with a tearable face is opened and resealed by a label. The container face preferably includes a U-shaped slit to form a tongue with part of the label. The label has a dry side and an adhesive side, the adhesive side attached to the container face with releasable adhesive. The adhesive side also has a dry noncoated section at one end to serve as a pull tab. When the dry pull tab is lifted, the label lifts and tears the container along the preformed slit, lifting the tongue to form an opening. The label is resealed by pressing the label back into position over the opening. For better alignment, the label may be partially coated with permanent adhesive. Tamper evidence tabs and slits are also provided.

5 Claims, 14 Drawing Figures

LABEL RESEALING CONTAINER

BACKGROUND OF THE INVENTION

1. Field of the Invention

This invention relates to packages, and more particularly to packages resealable after opening.

2. Description of the Prior Art

The use of paper, cellophane and other materials for construcion of packages which are capable of being easily torn is common in the art. These expensive packaging materials are popular with manufacturers for their ease of use, as well as for economic reasons. Many packages made of such materials are not reclosable or resealable. Of those that reclose (such as cereal boxes), there is reclosing but not resealing. Many food items (such as candies, cookies or potato chips) are packaged in tearable materials, but they are not capable of resealing. In addition to the problem of resealing, packages made of tearable materials often tear farther than desired and become incapable of being used.

To solve that problem, tear strips have been used with heat sealed polyfilm packages. The tear strips, however, limit the area of opening. Some package designs, for example A. Schmermund (Germany Pat. No. 1,112,691), slits a sheet of wrappings, inserts a tearstrip underneath the slit, slits the tearstrip and then joins the open edges by a strip of adhesive, the adhesive holding the original slit closed until initial opening. Platt in U.S. Pat. No. 3,279,331 shows a variety of flexible containers which reseal by use of adhesive on an inwardly folded package lip. Hughes in U.S. Pat. No. 2,949,370 provides two separate seals, one permanent and broken upon original opening of the package, and another for resealing the package, the resealing provided by a segment of pressure sensitive reseal material being joined to itself.

As the technology of packaging and adhesives improves, new, easier and more efficient package closures must be developed which will not only be economic, but which will reseal easily.

Additionally, because of recent problems with package tampering, the consumer has shown a desire to be able to determine if a package or its contents have been contaminated. This is a particular problem for producers of goods sold in resealable packages.

There is, therefore, a need for new and improved resealable containers which are easy to open and reclose, which reseal efficiently, and which offer proof of tampering with the seal.

SUMMARY OF THE DISCLOSURE

The aforementioned prior art problems are obviated by the label resealing container of this invention. In the preferred embodiment, a container is constructed so that at least one face is capable of being torn with the normal pressure of human fingers. A slit, preferably U-shaped, is preformed in the tearable face. A resealable label, sized to overfit the slit area, is attached to the tearable face. The label is dry on its upper surface, and its lower surface is coated with releasable, preferably pressure sensitive, adhesive. One area of the underside is left uncoated to provide an area to grasp as a pull tab. The container is opened by pulling up the pull tab, the area defined by the preformed container slit adhering to the label's underside and exposing an opening for the container. The container is resealed by pressing the label back over the opening.

Other embodiments have both permanent and releasable adhesive on the label. Some embodiments have slits in the label to indicate tampering. Others have tamper evident tabs.

It is therefore an object of this invention to provide a label sealing container which reseals by finger pressure.

It is another object of this invention to provide a partially releasable label which remains attached to a container in alignment with the container's opening.

It is yet another object of this invention to provide a label resealing container which includes a tamper evident pull tab.

It is still another object of this invention to provide a container which is opened by a label tearing a container open when the label is lifted.

It is a further object of this invention to provide a label sealing container in which container openings are preformed and then covered by a label.

It is still a further object of this invention to provide a label sealing container which provides a double label system for use with paper containers.

It is yet a further object of this invention to provide a label sealing system which is usable with any container having at least one tearable face regardless of container shape or composition.

These and other objects will be more readily ascertainable to one skilled in the art from a consideration of the following description, Figures and exemplary embodiments.

BRIEF DESCRIPTION OF THE DRAWING(S)

Figure 7:
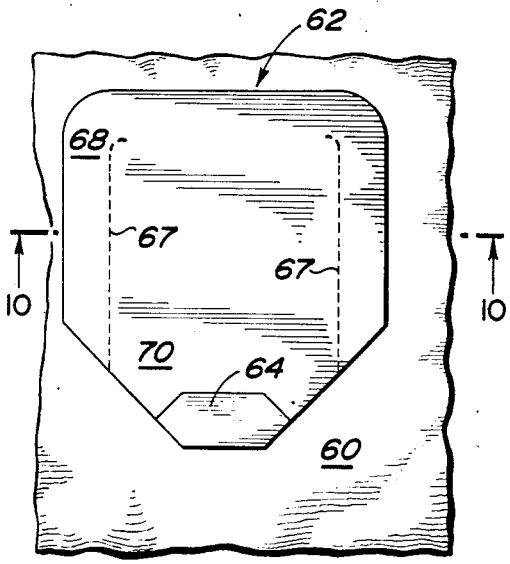
FIG. 7 is a fragmentary view of a container face with no preformed slit, an alternative label attached to the face.
Figure 10:
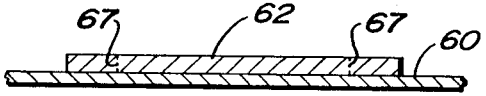

FIG. 10 is a cross section taken on lines 10—10 of FIG. 7 showing uncut container face 60 and label 62.

Figure 11:
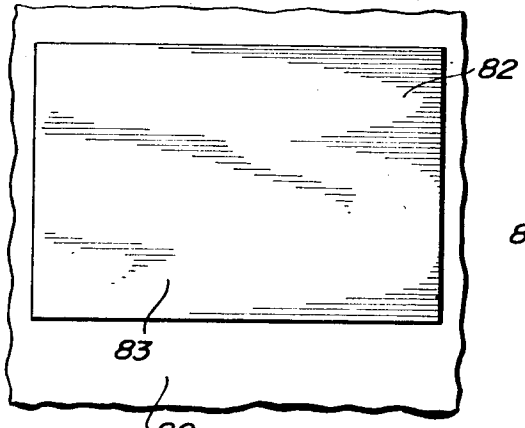

FIG. 11 shows a fragment of a container face fitted with a first permanently attached label in a double label system.

Figure 12:
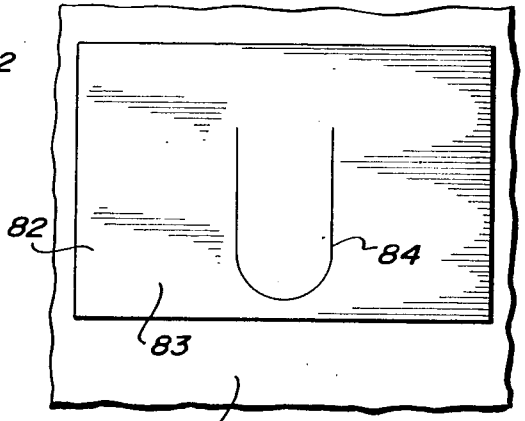

FIG. 12 shows the label of FIG. 11 with a preformed slit.

Figure 13:
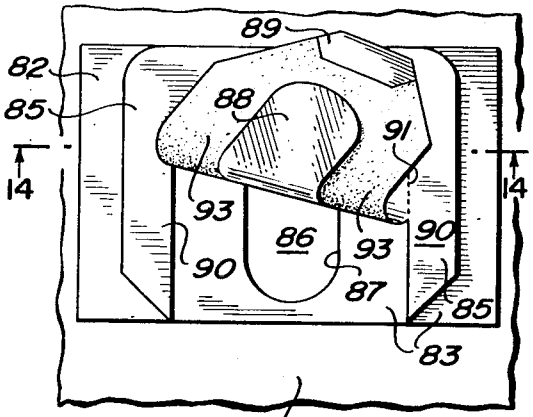

FIG. 13 shows a fragment of the container face of FIGS. 11 and 12 with a releasable label attached to the label of FIGS. 11 and 12.

Figure 14:
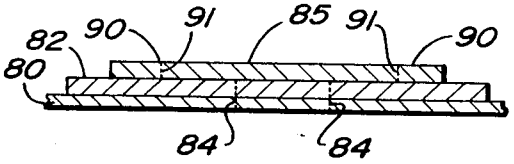

FIG. 14 is a cross section of a double label embodiment taken on lines 14—14 of FIG. 13.

DETAILED DESCRIPTION OF THE PREFERRED EMBODIMENT(S)

Figure 1:
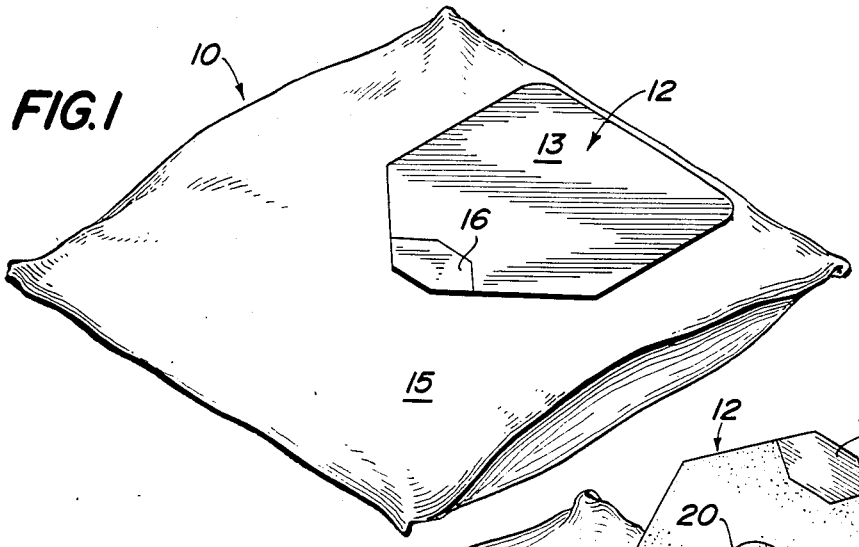
FIG. 1 is an isometric view of the preferred embodiment of this invention with the label sealing a container of the bag type.
Figure 2:
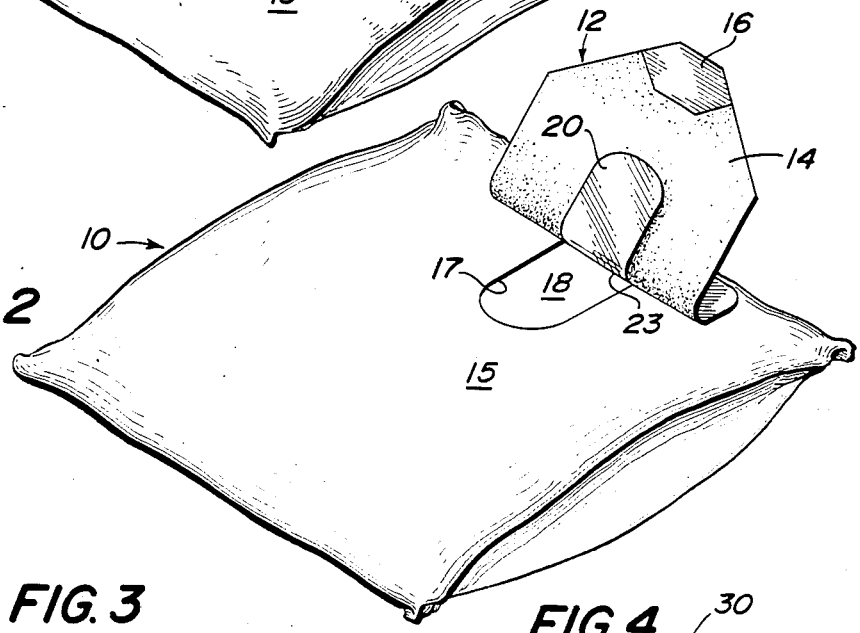
FIG. 2 is an isometric view showing the container of FIG. 1 with the label pulled upwards to open the container by exposing the preformed opening area.
Figure 3:
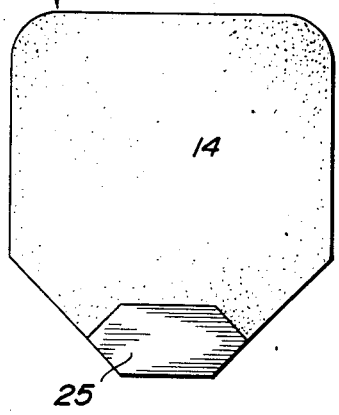
FIG. 3 is a bottom view of the label of FIGS. 1 and 2.

Now referring to the drawings, and more particularly to FIGS. 1, 2 and 3, the preferred embodiment of this invention is illustrated. Bag 10 is shown with tearable face 15. By tearable is meant a material capable of being torn with normal pressure exerted by human fingers. Examples of tearable would be paper, polyfilm, cellophane, etc. Although the invention is pictured in FIGS. 1 and 2 as being a bag container, it should be understood that the container can be shaped as a box, a cylinder, a bag, or any other shape suitable to the product being packaged. As long as one face of the container is made of a tearable material, the label sealing system illustrated herein is appropriate.

FIG. 1 illustrates bag 10 sealed by label 12. Label 12 with dry upper side 13 and pull tab 16 is attached to tearable face 15 of bag 10. Opening 18 (seen in FIG. 2) is completely covered by label 12 so that the contents of bag 10 are sealed inside and not exposed to the air or humidity.

In FIG. 2, bag 10 has been opened by pulling tab 16 up and away from face 15. Face 15 has preferably preformed, U-shaped slit 17. Slitting face 15 in a U-shape rather than a straight slit imparts strength to the slit because the curved slit will be stronger than a straight one. Slit 17 forms a tongue 20 in face 15. Tongue 20 adheres to label 12 and is pulled upward when tab 16 is lifted, tearing face 15 along slit 17 to form bag opening 18.

As seen in FIG. 3, underside 14 of label 12 is coated with releasable adhesive except for area 25, which is noncoated. Area 25 is noncoated to provide an area for grasping, making area 25 usable as pull tab 16. When tab 16 is lifted, tongue 20 adheres to label underside 14 and is pulled up by label 12, opening container 10 by exposing opening 18. Because underside 14 is preferably coated with a pressure sensitive, releasable adhesive, label 12 is easily lifted and then easily pressed back over opening 18 to reseal bag 10.

Since slit 17 is U-shaped, tongue 20, when attached to label 12, acts as a hinge, end 23 still attached to face 15. Thus, tongue 20 serves two purposes—it lifts off face 15 to form opening 18, and it keeps label 12 attached to surface 15 and aligned over opening 18 for quick and efficient reclosing of bag 10.

FIGS. 1, 2 and 3 illustrate the basic advantages of this invention. First, label sealing is adaptable to any container with at least one tearable face. A preformed, U-shaped, slit produces a tongue flap in a strong shape which remains attached to the face. Adhesive is coated on the label underside to retain the tongue flap and to keep the label properly aligned. A dry area is provided for a pull tab while pressure sensitive releasable adhesive coats the rest of label underside 14 to provide for resealing.

Figure 4:
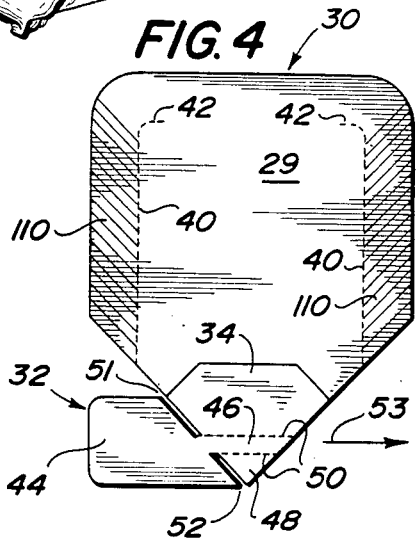
FIG. 4 is a top view of an alternate embodiment of the label with permanent adhesive, and tamper evidence tab and slits.
Figure 5:
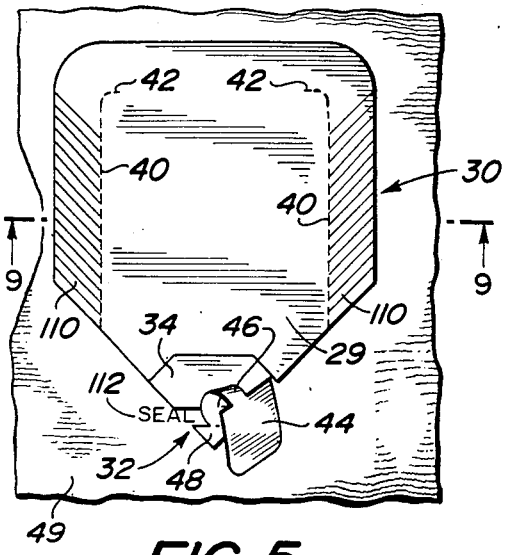
FIG. 5 is a fragmentary view of a container with the label of FIG. 4 adhered to a container face, the tamper evidence tab partially removed.
Figure 6:
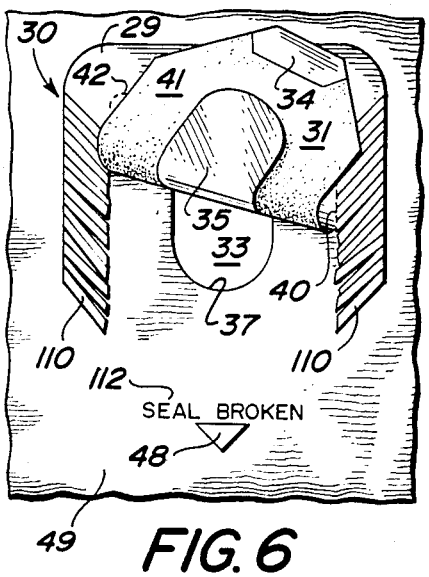
FIG. 6 is a fragmentary view showing the container of FIG. 5 opened.

Now referring to FIGS. 4, 5 and 6, an alternate embodiment of the label of this invention is shown which uses permanent adhesive and has a tamper evidence. For the purpose of simplification, it is understood in reference to FIGS. 4, 5 and 6 that tearable face 49 of a container has a preferably U-shaped, preformed slit 37 which forms a tongue 35 and opening 33 in the same manner as described with reference to FIGS. 1, 2 and 3. Label 30 is like label 10 except for the addition of permanent adhesive and tamper evidence.

Label 30 has pull tab 34, slits 110 and perforations 40 and 42. When placed on tearable face 49 of a container, label 30 will have a dry upper side 29 (as seen in FIGS. 4 and 5) and a coated underside 31 (partially shown in FIG. 6). Perforations 40 and 42 define the limits of the different adhesive areas on the underside of label 30. When label 30 is lifted by tab 34, label 30 tears along perforations 40. The area on the periphery of label 30 is attached to face 49 by permanent adhesive. An area mirroring tongue 35 is coated with permanent adhesive. Area 41 between the two areas coated with permanent adhesive is coated with releasable adhesive. Area of pull tab 34 is dry on both sides. Perforations 42 at the top edge of perforations 40 act as a stop, preventing label 30 from ripping further. By coating peripheral areas of label underside 31 with permanent adhesive, the alignment of label 30 over opening 33 is made more certain. Thus, although perforations 40 and 42 and additional peripheral permanent adhesive are beneficial, they are not always essential.

The second variation shown in FIGS. 4, 5 and 6 is the use of tamper evidence tab 32. Although tamper evidence tab 32 is illustrated only in FIGS. 4, 5 and 6, tab 32 may be adapted to any embodiment of the label sealing systems of this invention. Tab 32 has three sections—dry edge 44, cross piece 46 and permanent section 48, the sections defined by perforations 50 and slits 51 and 52. Tab 32 is attached to pull tab 34 by section 46.

In use, a person grasps dry edge 44 and pulls it in the direction of arrow 53 to release tab 34 for use. Portions 44 and 46, being dry on both sides, pull completely off face 49, leaving tab 34 free for grasping. As evidence of tampering, area 48 remains attached by permanent adhesive to face 49.

Further, as seen in FIG. 6, when tab 32 is removed, an indicia 112 on face 49 can read "seal broken" or "package opened" which will alert the purchaser as to evidence of tampering.

Also shown in FIGS. 4, 5 and 6 are slits 110. When label 30 is pulled upward, slits 110 become misaligned, giving additional evidence that the container has been tampered with as is shown in FIG. 6.

Figure 8:
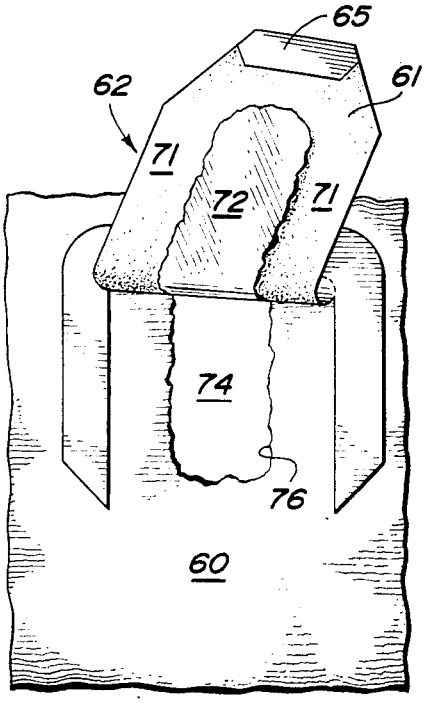
FIG. 8 shows a fragmentary container face without a preformed slit, the label ripping the bag when lifted.

Now referring to FIGS. 7 and 8, an embodiment to be used with a container having no preformed slit is illustrated. Tearable face 60 has label 62 attached. Label 62, with dry side 68, has area 70 defined by pull tab 64 and perforations 67. Label underside 61 has dry area 65 for pull tab 64, permanent adhesive around its periphery (not seen but indicated by perforations 67) and also near its center in a tongue shape. Releasable adhesive coats area 71. When pull tab 64 is lifted, face 60 is torn along an area which is sealed to the tongue-shaped area of label 62 to form tongue 72. Tongue 72 remains permanently attached to label 62, thus forming opening 74 with torn edges 76.

Figure 9:
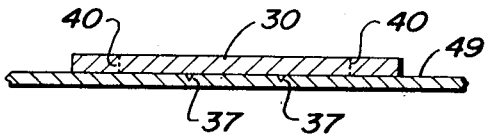
FIG. 9 is a cross section taken on lines 9—9 of FIG. 6 showing the label and container perforations.

FIGS. 9 and 10 illustrate, in cross section, the layers of labels and faces previously discussed. FIG. 9, taken on lines 9—9 of FIG. 6 also illustrates the container of the preferred embodiment of FIG. 1. Container face 49 has preformed slit 37 which is completely covered by label 30. Label 30 has perforations 40 which define the area which lifts when the label is pulled upward.

FIG. 10 is a cross section taken on lines 10—10 of FIG. 7. Container face 60 has no preformed slits. Label 62 has perforations 67 which define the label area lifted to open the container.

Now referring to FIGS. 11, 12, 13 and 14, another alternate embodiment of the label and container is shown. The double label illustrated in FIGS. 11, 12, 13 and 14 is preferable for use with paper containers or containers made of material which tears unevenly and in several directions. Container tearable face 80 is seen with label 82 permanently affixed to it. Label 82 has an adhesive side permanently fastened to face 80 and a dry side 83 facing upward. A slit, preferably U-shaped, is preformed through both label 82 and face 80 to form edges 84 on label 82 and 87 on face 80. A second label 85 is affixed over label 82 in the same manner as described with reference to labels in FIGS. 1, 2, 5, 6, 7 and 8.

In use, label 85 is lifted by pull tab 89, label 85 separating along perforations 91 and area 90 remaining permanently affixed to label 82. Because a a tongue-shaped area of the underside of label 85 is coated with permanent adhesive, tongue 88 of face 80 and the unseen tongue formed by slits 84 in label 82 are raised and remain attached to label 85, creating opening 86 in face 80. Because label 82 is permanently attached to face 80 and has preformed slit edges 84, face 80 tears only along preformed slit 87, more extensive tearing prevented by label 82. Releasable adhesive on area 93 provides for resealing.

FIG. 14 illustrates the double label system of FIGS. 11, 12 and 13 in cross section. Container face 80 and first label 82 have slits 84. Label 85 has perforations 91 to define area 80 remaining on face 83 when label 85 is lifted.

There are many variations of the label sealing container of this invention. Although generally square labels have been shown, the labels may be of any shape. A u-shaped slit is preferred for both strength and convenience, but other curved or other shaped slits may be employed.

It should be understood that the use of both permanent and releasable adhesive on the label's underside is not limited to the views illustrated. Any combination of adhesive positions is within the scope of this invention. For example, in FIG. 6, the area under tongue 35 may just as easily be coated with releasable adhesive.

Also, all possible combinations of tabs, slits and perforations have not been illustrated. It should be understood, however, that perforations 40 may be added to label 10 or tab 32 added to other embodiments. The elements of the label sealing system are interchangeable among all the embodiments shown and all within the scope of this invention.

Although polyfilm paper and cellophane are preferred for the containers, and adhesive coated paper for the labels, any materials which will tear and seal as described are within the scope of this invention.

When the containers are described as having preformed slits, those slits may be cut or punched or slit, depending on manufacturer's preference.

There are many advantages to the label sealing containers of this invention. First the labels may be shaped and sized to be used on containers of any size or shape. Also, the labels may have printing on their upper surface for product name or opening instructions.

The labels can give evidence of tampering.

Tearable material can be used for the entire container, or for only one side such as for the lid of a box.

Having now illustrated and described my invention, it is not my intention that such description limit the invention, but that the invention be limited only by a reasonable interpretation of the appended claims.

What is claimed is:

1. A resealable container comprising:

(a) a container with at least one face capable of being torn, said tearable face including a preformed, generally U-shaped slit, said slit forming a tongue flap in said tearable face;

(b) a releasable label having one dry side and one adhesive side, said adhesive side coated with releasable, pressure sensitive adhesive and including an uncoated section at one label end to form a pull tab, said label adhesive side facing and adhering to said container's tearable face so that said label completely surrounds and overfits said container's U-shaped slit; and, (c) a pull tab extension adjoining said pull tab with perforations defining said pull tab edge, said extension having generally two dry sides but with one area on one side of said extension including permanent adhesive to hold said tab and extension to said container until opening so that when said extension is pulled, it releases said tab to allow opening of said container and leaves said adhesive extension area fastened to said container as evidence of unsealing.

2. A resealable container comprising:

(a) a container with at least one face capable of being torn, said tearable face incuding a precut generally U-shaped slit to form a tongue;

(b) a partially releasable label having one dry side and one adhesive side, said label adhesive side facing and adhering to said container's tearable face so that said label completely surrounds and overfits said container opening, said adhesive side being divided into three discrete sections, a first section being coated with permanent adhesive, said permanent adhesive section divided into two areas, said first permanent adhesive area located at one label edge and said second permanent adhesive area being generally tongue shaped and located over said container's tongue, a second label section located between said two permanent adhesive area, said second label section coated with releasable pressure sensitive adhesive to permit reclosing, and a third section at the label edge opposite said first permanent adhesive area said third section being non-coated to form a pull tab; and, (c) a pull tab extension adjoining said pull tab with perforations defining said pull tab edge, said extension having generally two dry sides but with one area on one side of said extension including permanent adhesive to hold said tab and extension to said container until opening so that when said extension is pulled, it releases said tab to allow opening of said container and leaves said adhesive extension area fastened to said container as evidence of unsealing.

3. In a resealable container with at least one face being of a tearable material, said tearable face including a preformed slit to form a tongue flap in said tearable face, the improvement comprising:

(a) a partially releasable label having one dry side and one adhesive side, said label adhesive side facing and adhering to said container's tearable face, said adhesive side being divided into three discrete sections, a first uncoated section at one label edge to form a pull tab, a second section coated with permanent adhesive, said second section divided into two areas, said first permenent adhesive area located at said label's edge opposite said pull tab and said second permanent adhesive area located proximate said label's center and being generally shaped to be a mirror image of said container's tongue, the remainder of said label's adhesive side coated with releasable adhesive;

(b) a pull tab extension adjoining said pull tab with perforations defining said pull tab edge, said extension having generally two dry sides but with one area on one side of said extension including permanent adhesive to hold said tab and extension to said container until opening so that when said extension is pulled, it releases said tab to allow opening of said container and leaves said adhesive extension area fastened to said container as evidence of unsealing.

4. A resealable container comprising:

(a) a container with at least one face being of a tearable material, said tearable face including a preformed, generally U-shaped slit, said slit forming a tongue flap in said tearable face;

(b) a partially releasable label having one dry side and one adhesive side, said label adhesive side facing and adhering to said container's tearable face, said adhesive side being divided into three discrete sections, a first uncoated section at one label edge to form a pull tab, a second divided section coated with permanent adhesive, said first permanent adhesive area located at said label's edge opposite said uncoated edge and a second permanent adhesive area shaped generally as a mirror image of said container's tongue and located proximate said label's center, and a third peripheral section coated with releasable adhesive, said third peripheral section generally surrounding said tongue-shaped area and including precut slits to provide visible evidence of label opening.

5. A reclosable container comprising:

(a) a container with at least one face capable of being torn;

(b) a releasable label, said label having one dry side and one adhesive side, said adhesive side having at least three discrete sections, a first non-coated section at one label edge to serve as a pull tab, a second section coated with permanent adhesive, said permanent adhesive on said label's edge opposite said dry edge, additional permanent adhesive coating said label proximate said adhesive side's center, and a third section between said permanent adhesive sections coated with releasable adhesive; and, (c) a pull tab extension adjoining said pull tab with perforations defining said tab edge, said extension having generally two dry sides but with one area on one side of said extension including permanent adhesive to hold said tab and extension to said container until opening so that when said extension is pulled, it releases said tab to allow opening of said container and leaves said adhesive extension area fastened to said container as evidence of unsealing, whereby when said pull tab is lifted, said container is torn open where said label's center adhesive section is attached to said container, said label remaining affixed at one edge to said container in registration with said container opening so that when said label is pressed down, said opening is resealed.

* * * * *